US006964230B2

(12) United States Patent
Mörke et al.

(10) Patent No.: US 6,964,230 B2
(45) Date of Patent: Nov. 15, 2005

(54) METHOD OF AND APPARATUS FOR APPLYING, MONITORING AND CORRECTING PATTERNS OF ADHESIVE ON RUNNING WEBS OF PAPER AND THE LIKE

(75) Inventors: Torsten Mörke, Dissau (DE); Rainer Steinfatt, Glinde (DE); Berthold Maiwald, Schwarzenbek (DE); Karl-Heinz Pawelko, Marschacht (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/820,793

(22) Filed: Apr. 9, 2004

(65) Prior Publication Data

US 2004/0226465 A1 Nov. 18, 2004

Related U.S. Application Data

(63) Continuation of application No. PCT/EP02/11207, filed on Oct. 7, 2002.

(30) Foreign Application Priority Data

Oct. 12, 2001 (DE) ..... 101 50 272

(51) Int. Cl.[7] ..... B41F 1/54

(52) U.S. Cl. ..... 101/484; 101/483; 131/34; 131/69

(58) Field of Search ..... 101/483–485; 131/34–37, 69, 90, 180, 284

(56) References Cited

U.S. PATENT DOCUMENTS

| | | | | |
|---|---|---|---|---|
| 4,845,374 A | | 7/1989 | White et al. | |
| 5,054,346 A | | 10/1991 | Heitmann | |
| 5,135,008 A | | 8/1992 | Oesterling et al. | |
| 5,531,233 A | * | 7/1996 | Oglesby et al. | 131/69 |
| 5,735,292 A | * | 4/1998 | Draghetti | 131/34 |
| 5,769,947 A | | 6/1998 | Krappweis | |
| 5,807,606 A | | 9/1998 | Mould et al. | |
| 6,543,457 B2 | * | 4/2003 | Maiwald et al. | 131/34 |
| 2002/0023655 A1 | * | 2/2002 | Fietkau | 131/284 |

FOREIGN PATENT DOCUMENTS

| | | |
|---|---|---|
| EP | 0 766 928 A1 | 4/1997 |
| EP | 1 161 888 A2 | 12/2001 |
| GB | 2 289 941 A | 12/1995 |
| WO | WO 99/29191 A2 | 6/1999 |

* cited by examiner

*Primary Examiner*—Minh Chau
(74) *Attorney, Agent, or Firm*—Venable LLP; Robert Kinberg; Catherine M. Voorhees

(57) ABSTRACT

An improved method of and an improved apparatus for detecting and correcting unsatisfactory patterns of adhesive is applied to a running web of paper or the like in a tobacco processing machine by a cyclically operated paster. A linear scanning camera is employed to take pictures of groups of at least some of the patterns which are applied during successive cycles of the paster, and such pictures are displayed and compared with a reference image of satisfactory patterns and preferably also with additional reference images. The results of comparison are relied upon for the making of corrections, for example, by changing the operation of the paster and/or by changing the direction of advancement of the web between the paster and the camera.

18 Claims, 4 Drawing Sheets

METHOD OF AND APPARATUS FOR APPLYING, MONITORING AND CORRECTING PATTERNS OF ADHESIVE ON RUNNING WEBS OF PAPER AND THE LIKE

CROSS-REFERENCE TO RELATED APPLICATION

This application is a continuation of International Application No. PCT/EP02/11207, filed on Oct. 7, 2002, designating the United States, which claims priority to German Application No. 101 50 272.9, filed on Oct. 12, 2001, the disclosures of the above application and each U.S. and foreign patent and patent application mentioned below are incorporated herein by reference.

BACKGROUND OF THE INVENTION

The present invention relates to improvements in methods of and in apparatus for cyclically applying, monitoring and/or correcting adhesive patterns which serve to cause bands, strips, sheets or analogous commodities to adhere to each other and/or to other parts, especially in conjunction with the making and/or packing of rod-shaped smokers' products.

It is well known to coat cigarette paper, uniting bands and analogous sheet-like or strip-shaped commodities with an adhesive substance which causes the commodities to adhere to each other and/or to other parts, e.g., in connection with the making of filter cigarettes. For example, PCT/EP No. 98/06561 discloses a camera which is utilized as an optical monitoring unit and employs an objective connected to the camera body by an elongated optical conductor. The objective is installed at a location where it is not readily accessible and/or observable. The purpose of such camera is to ascertain whether or not one or more layers of an adhesive were properly applied to one or more sections of wrapping material.

U.S. Pat. No. 4,845,374 (granted Jul. 4, 1989 to White et al. for "METHOD AND APPARATUS FOR DETECTING THE DEPOSITION OF AN ADHESIVE ON A TRAVELLING WEB") discloses a method of and an apparatus for intercepting and/or monitoring radiation being reflected by a travelling web in order to ascertain whether or not the web carries a substance or material. To this end, the web is exposed to diffuse light and the light being reflected by the web is monitored by a detector which is set up to ascertain the presence and/or the width of the adhesive-coated portions of the web on the basis of reflection of diffuse light at the coated surface of the web.

OBJECTS OF THE INVENTION

An object of the present invention is to provide a novel and improved method which is superior to presently known methods of applying, monitoring and/or correcting adhesive patterns on sheet- or strip-like commodities, particularly on moving strips or webs of wrapping material for use in the tobacco processing industry.

Another object of this invention is to provide a novel and improved apparatus for the practice of the improved method.

A further object of the invention is to provide novel and improved modes of predictably applying a non-rigid substance, such as an adhesive paste or liquid, to an advancing web of cigarette paper or tipping paper in machines for the making of plain or filter cigarettes, cigars, cigarillos and/or analogous rod-shaped smokers' products or component parts of smokers' products as well as of simplifying adjustments of such machines when the applied patterns of the substances depart from desired or optimum or acceptable patterns.

An additional object of our invention is to improve the operation and cooperation of adhesive applicators, cutters and/or quality monitoring devices in machines for the making of smokers' products and/or component parts of smokers' products and/or in machines for wrapping or packaging smokers' products.

Still another object of the invention is to provide a novel and improved method of and apparatus for optimizing the application of adhesive or the like to a running web or strip of cigarette paper, tipping paper or the like.

A further object of this invention is to reduce the number of rejects in machines for the making of plain or filter cigarettes and/or other smokers' products.

SUMMARY OF THE INVENTION

One feature of the present invention resides in the provision of a method of monitoring patterns which are applied to a running web of cigarette paper, tipping paper or other wrapping material for smokers' products by a cyclically operated paster. The method comprises the steps of making discrete images of successive patterns on the running web, forming a composite image of the images of at least some of the patterns applied during a cycle of the paster, and depicting the composite image.

Another feature of the invention resides in the provision of a method of optimizing patterns which are applied to a running web of wrapping material for smokers' products by a cyclically operated paster. This method comprises the steps of making discrete images or pictures of successive patterns on the running web, forming a composite image of the images or pictures of at least some of the patterns applied during a cycle of the paster, comparing the composite image with a reference image (such reference image can be representative of a series of satisfactory patterns), and initiating changes of discrete patterns when the comparing step indicates a departure of the composite image from the reference image.

The pattern applying step can include advancing the web from the paster at a variable angle, and the initiating step can include changing such angle when the composite image departs from the reference image. Such method can further comprise the steps of comparing the composite image with at least one additional reference image which is indicative of a departure of the aforementioned angle from an optimal angle in a first direction, and changing the angle in a second direction counter to the first direction when the composite image departs from the at least one additional reference image in the first direction.

Alternatively, the just discussed method can further comprise the steps of comparing the composite image with a first additional reference image which is indicative of a departure of the aforementioned angle from an optimal angle in a first direction, comparing the composite image with a second additional reference image which is indicative of a departure of the aforementioned angle from the optimal angle in a second direction counter to the first direction, increasing the angle when the composite image departs from the reference image in a direction toward the first additional image, and reducing the angle when the composite image departs from the reference image in a direction toward the second reference image. The departure in the first direction is or can be indicative of an angle smaller than the angle then the composite image matches the reference image, and the departure in the second direction can indicate an angle which is greater than the angle when the composite image matches the reference image.

A further feature of our invention resides in the provision of an apparatus for monitoring patterns which are applied to a running web of cigarette paper, tipping paper or other wrapping material for smokers' products. This apparatus comprises an associated paster which is arranged to cyclically apply adhesive patterns to successive sections of the running web, a camera which is arranged to make pictures of successive groups of patterns, means for evaluating the pictures including means for making composite images of patterns which are applied to the running web during a portion of or during the entirety of each cycle of the paster, and means for displaying the images.

The apparatus can further comprise first signal generating means which is arranged to furnish to the camera a series of first signals at a first frequency (such signals denote the rate of application of patterns to the paster) and second signal generating means which is arranged to transmit to the camera a series of second signals at a second frequency which is higher than the first frequency. The evaluating means is operatively connected with the camera and the latter is arranged to make a picture substantially in response to each second signal and to transmit the picture to the evaluating means which is arranged to make an image from at least some of the pictures being transmitted thereto between successive first signals. The paster can comprise a paste applicator which can include a rotary valve or a rotary roller, and the first signal generating means is operatively connected with the paste applicator in such a way that the latter generates a first signal at the start of each full revolution of the paste applicator.

The camera is or can constitute a linear scanning camera which is arranged to make linear pictures of the patterns on the web. Such apparatus also includes a source of linear radiation (such as a light emitting diode) which is arranged to direct radiation upon those successive patterns of the web which are imaged by the camera. The objective of the camera is preferably directed or oriented substantially at a glancing angle to the plane of the pattern which is being imaged by the camera.

The improved apparatus further comprises means (such as one or more motor-driven rollers) for advancing the web in a predetermined direction along a predetermined path past the paster and the camera, means for severing the web downstream of the paster (as seen in the predetermined direction) at a variable frequency to subdivide the web into a series of uniting bands, and preferably also means for generating third signals at a frequency corresponding to the frequency at which the web is severed by the severing means. Such apparatus further comprises means for generating and integrating into the composite images information (such as control markers) which is derived from the frequency of the third signals. The control markers denote the cuts being made in the running web by the severing means.

An additional feature of the instant invention resides in the provision of an apparatus for optimizing adhesive patterns which are applied seriatim to a running web of cigarette paper, tipping paper or other wrapping material for smokers' products by a cyclically operated paster. This apparatus comprises a camera which is arranged to make pictures of successive series of patterns (each such series can include at least some of the patterns which are applied during a cycle of the paster), means for evaluating the pictures and for producing images of pictures of successive series of patterns, and means for storing a reference image. The evaluating means includes means for comparing the images of patterns with the reference image and means for altering the patterns being applied to the running web by the paster when the images of the patterns depart from the reference image.

The pattern optimizing apparatus further comprises means for advancing the web in a predetermined direction and along a predetermined path extending past the paster and thereupon past the camera, and the altering means of such apparatus can comprise an adjustable deflecting roller which engages the web downstream of the paster and upstream of the camera, as seen in the predetermined direction. The paster can include a portion (such as the aforementoned roller or valve) which coacts with the deflecting roller to change the orientation of successive increments of the web in response to adjustments of the paster portion and to thus change the patterns being applied to the web by the paster.

The storing means of the pattern optimizing apparatus can further store at least one additional reference image which is indicative of a departure of the images of patterns from the first mentioned reference image in at least one of two directions, and the evaluating means of such apparatus then further comprises means for comparing the images of patterns with the at least one additional reference image. The altering means of such apparatus is further arranged to alter the patterns when the images of the patterns depart from the additional reference image. Such altering means can be arranged to change the orientation of the web upstream of the camera in one direction when the images of the patterns depart from the additional reference image in another direction counter to the one direction.

A presently preferred embodiment of the pattern optimizing apparatus employs storing means which is arranged to further store first and second additional reference images which respectively indicate departures of images of the patterns from the first mentioned reference image in a first direction and in a second direction counter to the first direction. The evaluating means of such apparatus further includes means for comparing the images of the patterns with the additional reference images, and the altering means is then arranged to alter the patterns being applied to the web when the images of the patterns depart from the additional reference images. The altering means can include means for changing the orientation of the web between the paster and the camera in one direction when the images of the patterns being applied to the web depart from one of the additional reference images and for changing the orientation of the web between the paster and the camera in another direction counter to the one direction when the images of patterns being applied to the web depart from the other of the additional reference images.

The novel features which are considered as characteristic of the invention are set forth in particular in the appended claims. The improved apparatus itself, however, both as to its construction and the modes of assembling, installing and operating the same, together with numerous additional important features and attributes thereof, will be best understood upon perusal of the following detailed description of certain presently preferred embodiments with reference to the accompanying drawing.

DESCRIPTION OF PREFERRED EMBODIMENTS

Figure 1:
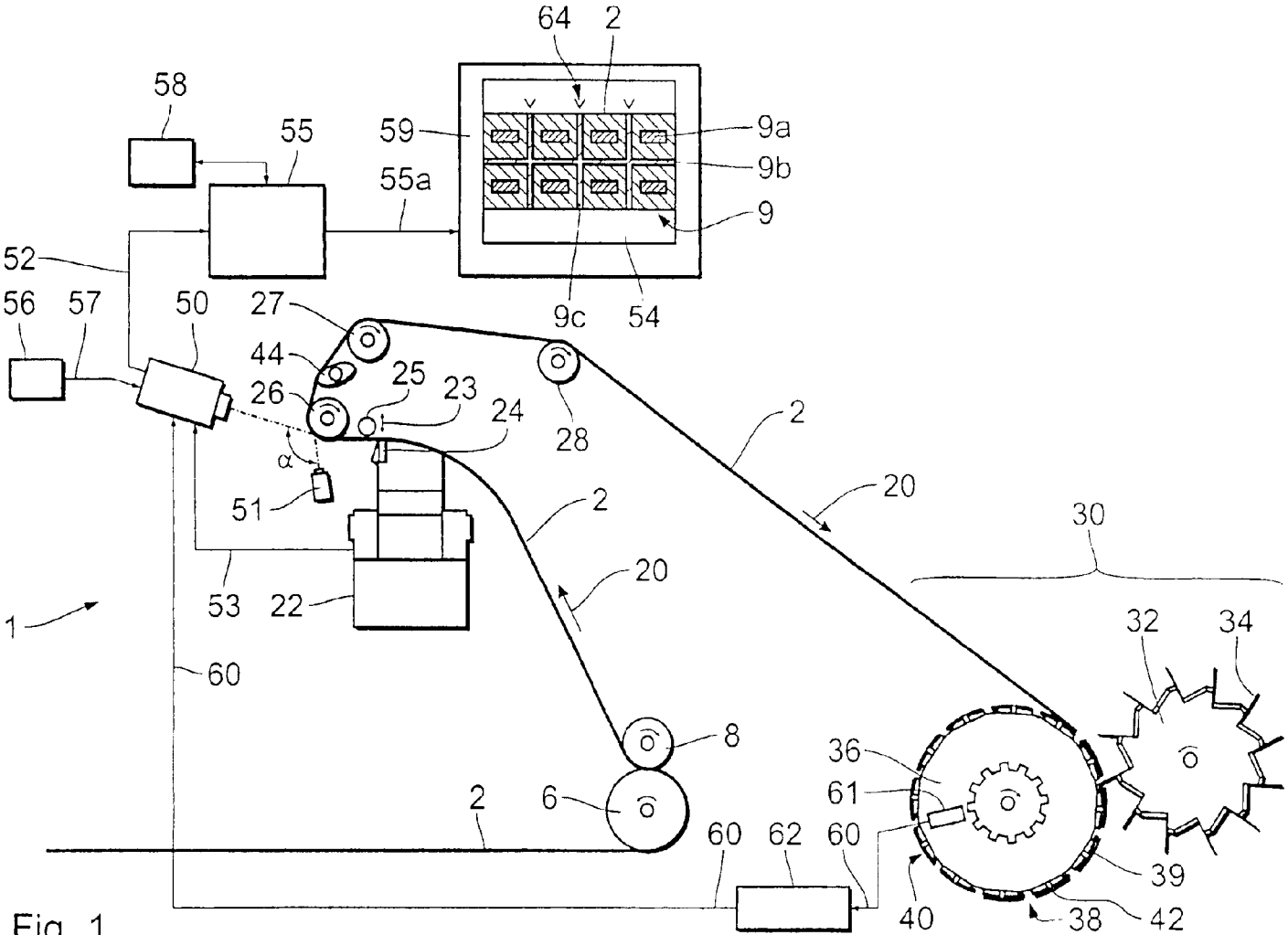
FIG. 1 is a partly schematic elevational view of a portion of a novel apparatus which can be utilized for the practice of the improved method and embodies novel means serving to monitor an adhesive-coated running web in a machine for the making of rod-shaped smokers' products.

The structure which is shown in FIG. 1 can be incorporated in a cigarette making machine 1, e.g., in a machine known as MAX which is distributed by the assignee of the present application. This machine processes a continuous strip or web 2 of cigarette paper, tipping paper or the like. The machine 1 utilizes an adhesive applying arrangement 22 which is called paster and serves to cyclically apply to the running web 2 a series or succession of adhesive patterns 9. FIG. 1 merely shows those constituents of the filter cigarette making machine 1 which are necessary for a full understanding of the present invention. A filter cigarette making machine which can embody the present invention is described and shown, for example, in commonly owned U.S. Pat. No. 5,135,008 granted Aug. 4, 1992 to Oesterling et al. for "METHOD OF AND APPARATUS FOR MAKING FILTER CIGARETTES".

The web 2 is drawn off a Toll (not shown) at a predetermined speed. FIG. 1 shows two rollers 6, 8 at least one of which (such as 6) is driven to advance the web 2 in the direction of arrows 20. The paster 22 is adjacent the path of the web 2 downstream of the advancing rollers 6, 8 and includes a nozzle 24 which applies to the running web a series of successive adhesive patterns 9. The nozzle 24 can be of the type disclosed in German patent No. 44 37 764 A1 and in the corresponding U.S. Pat. No. 5,769,947 granted Jun. 23, 1998 to Krappweis for "APPLICATOR FOR ADHESIVE AND CORRESPONDING NOZZLE PLATE". Each of the patterns 9 includes adhesive-free zones or regions 9*a*, 9*b* and 9*c*. The web 2 is to be cut along the adhesive-free zones 9*b*, 9*c* and is perforated or is to be perforated along the zones 9*a*.

The paster 22 is followed by a mobile first deflecting roller 25, which is reciprocable in directions indicated by a double-headed arrow 23, and by additional deflecting rollers 26, 27, 28 which guide successive increments of the web 2 toward a severing or comminuting device 30 serving to divide the web into a series of successive uniting bands 39. The purpose of such uniting bands is described in the aforementioned commonly owned U.S. Pat. No. 5,135,008 to Oesterling et al.

Figure 3:
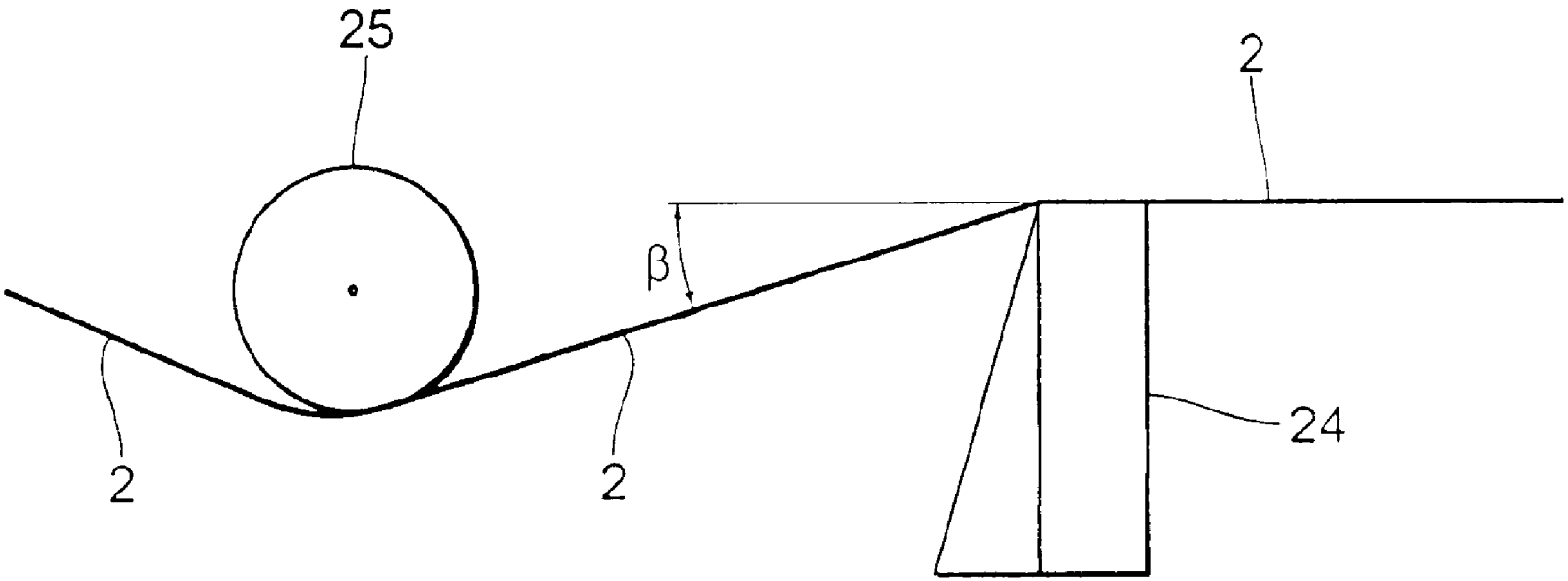
FIG. 3 is an enlarged view of an adhesive applying implement which can be utilized in the improved apparatus to apply variable patterns of adhesive or the like to the running web, such as an advancing strip of tipping paper.

As can be seen in FIG. 3, the nozzle 24 of the paster 22 and the mobile first deflecting roller 25 cooperate to incline the web portion between them through an angle $\beta$ relative to the inclination of the web 2 ahead of the nozzle 24. The magnitude of the angle $\beta$ determines, among certain other parameters, the characteristics of the patterns 9.

The severing device 30 is installed at a predetermined distance downstream of the nozzle 24 (as seen in the direction of arrows 20). Thus, the distance between the nozzle 24 and the locus of severing the web 2 is a fixed distance. This ensures that, once the nozzle 24 is properly adjusted, the adhesive patterns 9 being applied to successive increments of the running web 2 are located at predetermined distances from the locations where the web is severed.

The severing device 30 comprises a first rotary drum 32 for an array of nearly radially outwardly extending knives 34 which project beyond the periphery of this drum, and a second drum 36 which is rotated in a direction counter to that of the drum 32. The drum 36 is provided with peripheral recesses 38 for the cutting edges of the knives 34. The web 2 is trained over the peripheral surface of the drum 36 and is severed by successive knives 34 to yield a succession of discrete uniting bands 39. The drum 36 is provided with peripheral suction ports 42 which are disposed in the portions 40 of its peripheral surface between the recesses 38 to attract the web 2 and successive uniting bands 39. The exact manner in which the suction ports 42 communicate with a suitable suction generating device (not shown) forms no part of the present invention; such arrangements are well known in tobacco processing machines.

In a manner which is also known in the relevant art, a rotary oscillator 44 is installed adjacent the path of the web 2 between the deflecting rollers 26 and 27. The speed of the oscillator 44 is synchronized with that of the drums 32, 36 of the severing device 30 in such a way that, after each of the cuts performed by successive knives 34, the oscillator 44 retards the web 2 or even draws it rearwardly (i.e., counter to the direction indicated by the arrows 20) to thus establish gaps of predetermined widths between successive uniting bands 39. Otherwise stated, the oscillator 44 converts the constant-speed forward movement of the web 2 into a non-uniform movement involving higher-speed movements which alternate with lower-speed movements. Reference may be had to German patent No. 39 18 137 C2 and to the corresponding U.S. Pat. No. 5,054,346 granted Oct. 8, 1991 to Heitmann for "APPARATUS FOR REPEATEDLY SEVERING RUNNING WEBS OF TIPPING PAPER AND THE LIKE". Reference may also be had to the assignee's European patent application Serial No. 01113473.1 which discloses a presently preferred mode of synchronizing the operation of the adhesive applicator with that of the web severing device in a cigarette making machine or another machine for the processing of smokers' materials.

The monitoring and optimizing of the patterns 9 is carried out as follows:

The running web 2 is exposed to linear radiation issuing from a light source (lamp) 51 in such a way that the radiation impinges transversely of the direction (arrows 20) of advancement of the web. The objective lens of a linear scanning camera 50 is trained upon the linear radiation which impinges upon successive increments of the running web 2. The light source 51 is positioned in such a way that the radiation impinges upon the web 2 at a flat or low angle. The camera 50 observes the web 2 at a grazing or glancing angle $\alpha$ such as is necessary to ensure that it is properly focussed upon the region of optimal illumination of the web by the light source 51. When illuminated in the just outlined manner, the adhesive-free portions 9*a*, 9*b*, 9*c* of the web 2 appear to be dark, and the adhesive-coated portions of the web appear to be light.

For example, the linear scanning camera 50 can be of the type known as DALSA linear camera, 1024 Pixel, 30 kHz, SP-14-01k30. The light source 51 can constitute, for example, a linear light emitting diode which is arranged to direct upon the web 2 an 80-mm wide strip of white light.

At the start of a full revolution of the rotary valve of the nozzle 24, the drive for such valve transmits to the camera 50 a first signal (arrow 53 in FIG. 1) having a first frequency. In addition, the camera 50 receives a higher-frequency second signal 57 from a signal generator 56. The frequency of the second signal is proportional to the speed of the cigarette making machine 1. The camera 50 records a line in response to each second signal 57 and transmits a signal, via conductor means 52, to an evaluating circuit 55. The latter can constitute or include a personal computer which contains an image recognition card and picture editing software. The evaluating circuit 55 combines all of the lines between two successive first signals 53 into a composite image or picture 54 which thus represents all patterns 9 that were applied to the web 2 during a revolution of the rotary valve of the nozzle 24.

The evaluating circuit 55 further comprises a memory, a comparing stage and a correcting unit. The memory contains a reference image for optimal application of adhesive, a sample of a first additional reference image when the angle β (FIG. 3) is too large, and a sample of a second additional reference image when the angle β is too small. The comparing stage of the evaluating circuit 55 compares the composite image 54 with the reference image and with the additional (adhesive depicting) reference images. The correcting unit of the evaluating circuit 55 serves to alter the patterns 9 when the comparing stage ascertains the existence of a departure of composite image 54 from the reference image. For example, the correcting unit of the circuit 55 can influence the roller 25 to effect a change of the discrete patterns 9 by altering the angle β.

The operation of the comparing stage and correcting unit in the evaluating circuit 55 is as follows:

The comparing stage is resorted to in order to compare the composite image 54 with the additional reference image which is indicative of the situation when the angle β is excessive as well as with an additional reference image indicating a situation when the aforementioned angle β is too small. This enables the correcting unit of the evaluating circuit 55 to carry out the necessary correction, i.e., to increase or reduce the angle β. The result is an optimizing of the patterns 9.

The evaluating circuit 55 transmits the composite image 54 by way of a conductor 55*a*. The circuit 55 can repeatedly and automatically furnish new images 54 to thus produce a continuous still video of the running patterns 9. Alternatively, the circuit 55 can furnish images 54 only upon demand, i.e., to build first patterns 9. The composite image 54 can be stopped. Suitable conventional undertakings can be resorted to in order to memorize the images in a data carrier 58. The latter can constitute a floppy disc or a compact disc/read-only memory (CD-ROM).

Figure 2A:
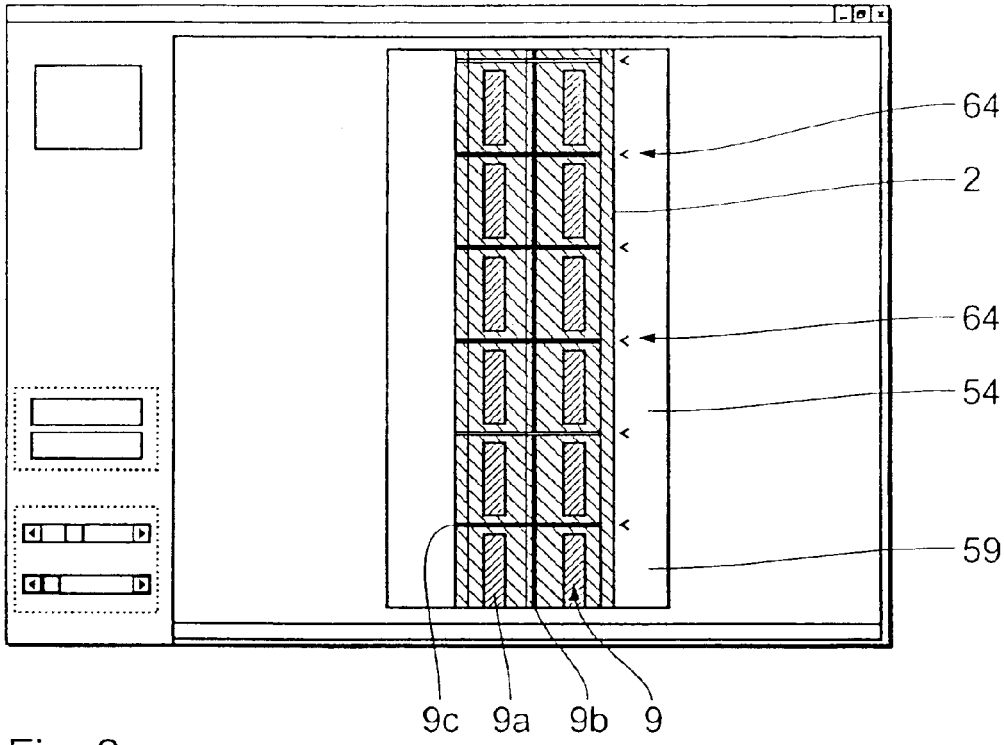
FIG. 2*a* is an enlarged view of a composite image which is obtained by resorting to the apparatus of FIG. 1.
Figure 2B:
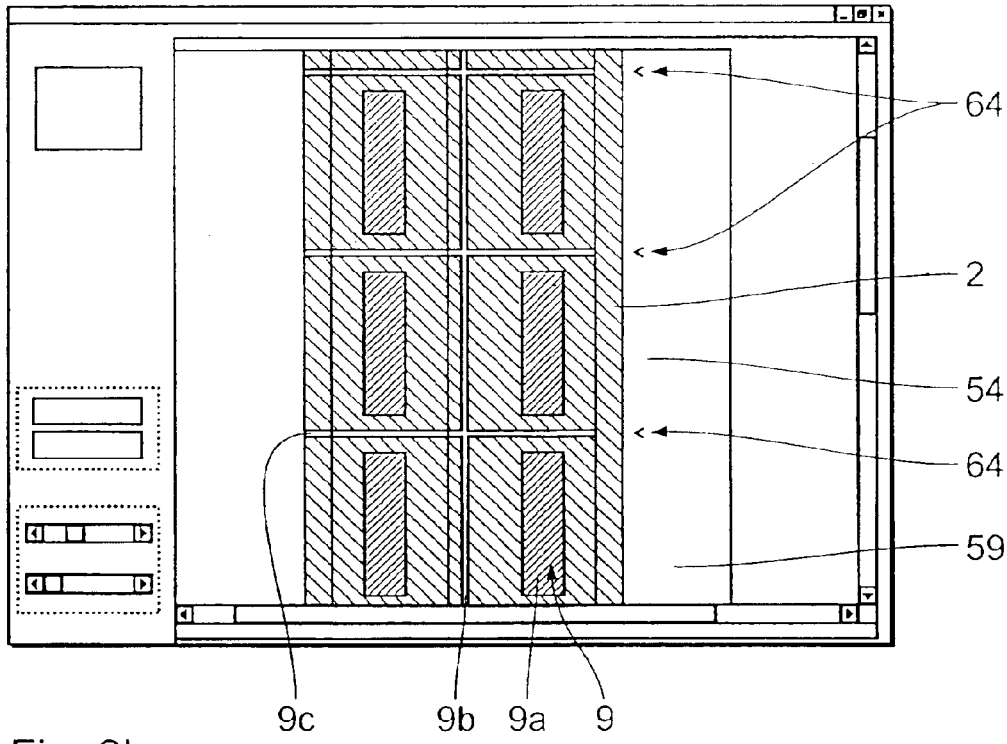
FIG. 2*b* is an enlarged view of a modified composite image.

By selectively enlarging portions of a composite image 54 (such enlarged image can be observed on an image displaying monitor 59, e.g., in a manner as illustrated in FIG. 2*b*), it is possible to replace patterns 9 corresponding to a full cycle of the nozzle 24 with a smaller number of such patterns. This can ensure that, during a continuous buildup of patterns, the selected section invariably shows those patterns 9 which correspond to a predetermined (preselected) section of the rotary valve forming part of the nozzle 24 in the paster 22.

Alternatively, the frequency of the second signals can be varied to select the number of patterns 9 which together constitute a composite image 54. Since each composite image 54 contains the same number of lines, the number of illustrated adhesive-denoting patterns 9 increases by reducing the frequency of the second signals. Such frequency of the second signals should remain proportional to the speed of the cigarette making machine 1. If, while resorting to such method, it is desired to represent a pattern other than the first pattern made during a revolution of the rotary valve of the nozzle 24, the start of the pattern buildup must be delayed by a few pulses of the second signal relative to the first signal (arrow 53).

In order to ascertain the positions of the patterns 9 relative to the cut in the web 2, the camera 50 can be arranged to receive a further signal 60 which is transmitted by a signal generator 62 receiving signals from a sensor or detector 61. The latter monitors the timing of severing of the web 2 by the knives 34 in the severing device 30. The further signal 60 can be resorted to in order to blend control markers 64 (see FIGS. 2*a* and 2*b*) into the composite image 54. The camera 50 must be calibrated to ensure proper positioning of the control markers 64. To this end, one ascertains the proper length of the web 2 between the observation line of the camera 50 and the point of impingement of a knife 34 upon the web 2. If such length is a whole multiple of known lengths of the uniting bands 39, the control marker 64 is blended into that line of the image which is depicted at the time of generation of the additional signal 60. Alternatively, the control marker 64 is shifted by a number of lines which are imaged during transport of the web 2 by a difference between the desired and actual distances. As concerns the parts 60–62, reference should be had to the aforementioned commonly owned European patent application Serial No. 01113473.1.

An important advantage of the improved method and apparatus is that, in spite of the high speed of a modern filter cigarette making or other tobacco and/or filter material processing machine, it is now possible to present to the attendant(s) a series of stationary images of successive adhesive patterns or groups of adhesive patterns. Such images can be readily evaluated in a manner superior to those presently known in connection with the detection and correction of defective patterns of adhesive or the like on rapidly advancing webs of tipping paper or the like. The improved method and apparatus enable the attendant(s) to evaluate the images of applied patterns for the required or desired periods of time.

Another advantage of the improved method and apparatus is that they enable the attendant(s) to detect and correct recurring errors or defects; this is in contrast to presently known methods and apparatus which only permit the ascertainment of defects in all of a long series of successive patterns.

A feature of our invention resides in the recognition that, in presently preferred apparatus, the paster is a cyclically operated device. For example, conventional pasters often employ adhesive transferring rollers or drums in contrast to the paster 22 which can utilize a nozzle in conjunction with at least one control roller or regulating roller or a rotary slide valve. Each cycle of the paster 22 can involve the making of several patterns 9. This permits for the making of stationary composite images 54, such as one new image 54 per cycle of the paster 22. As already mentioned hereinbefore, successive images 54 can be formed automatically or in response to signals from the attendant(s).

The first signals which are generated by the paster 22 (such as from the drive for the nozzle 24 forming part of the paster) and are transmitted (at 53) from the paster to the camera 50 (a) denote the starts of successive cycles of the paster, or (b) preferably denote essentially or approximately the starts of such cycles, or (c) are offset relative to the starts of the cycles by predetermined values, preferably by a multiple of the duration (period) of a second signal. (transmitted to the camera by the signal generator 56 via conductor means 57). This ensures that, for example, if the paster 22 employs an adhesive-applying roller, the camera 50 can depict each and every pattern 9 which is applied to the running web 2 during a cycle of the paster. For example, the start of a cycle can coincide with the start of a full revolution of the roller-shaped applicator of the paster 22. It is further preferred to ensure that the second signals (from the signal generator 56) be derived from the frequency of application of the individual patterns 9, i.e., that they essentially denote the frequency of pattern application by the paster 22 or that their frequency be proportional to the frequency of pattern application.

It is also within the purview of the present invention (and often preferable) to select an enlarged portion of an image or at least of less than all images which are made during a cycle of the paster 22 or an equivalent or analogous paster (e.g., one with a roller-shaped applicator in lieu of a nozzle-like applicator with a rotary valve or vice versa). Such selection of enlargements of portions of images can be carried out by resorting to well known image processing undertakings and devices; alternatively, one can achieve identical or at least similar results by appropriate selection of the frequency of second signals by increasing such frequency in order to reduce the number of discrete patterns 9 which appear on a picture or image 54. Such arrangement facilitates rapid recognition or detection and diagnosis or analysis of defective patterns. For example, the making of unsatisfactory patterns can be attributable to unsatisfactory procedural parameters (such as the pressure of adhesive and/or the mechanical pressure of a roller-shaped applicator of adhesive to the web 2 which advances along the paster) or to mechanical problems (such as low-quality images of patterns which are ground into or otherwise applied to the peripheral surface of a roller-shaped adhesive applicator, or defective segments of a rotary valve in a nozzle-shaped applicator). If the images at the periphery of a roller are unsatisfactory, this can result in random fluctuations of the patterns 9 on the web. On the other hand, if the segments of a nozzle are defective, all of a series of defective patterns exhibit the same deficiencies.

The radiation source 51 (such as the aforementioned light emitting diode) is preferably arranged to direct upon the advancing web 2 an uninterrupted beam of light, and the objective of the camera 50 is oriented at a grazing or glancing angle relative to the plane of the illuminated pattern. Such cooperation between the camera and the radiation source ensures that the pictures made by the camera are those of optimally illuminated portions of the running web.

As already mentioned hereinbefore, the quality of the images of patterns 9 is dependent, to a very high degree, upon the angle (β) at which the web 2 is caused to advance from the adhesive-discharging outlet of the paster 22 along the locus of illumination by the radiation source 51 and toward and past the picture-making section of the path for the running web 2. This is the reason that a presently preferred undertaking for correcting or improving the quality of images or pictures being taken by the camera 50 or an equivalent thereof includes or consists of changing the angle β. Such change is accomplished by appropriate adjustments of the roller 25, preferably at least in the directions indicated by the double-headed arrow 23, i.e., transversely of the direction (indicated by the arrows 20) of advancement of the web 2 in that portion of its path which extends between the paster 22 and the imaging location.

The aforementioned additional reference images can be stored in the memory of the evaluating circuit 55 or in discrete memory or memories. One of these additional reference images can denote that the angle β is too large, and the other additional reference image can denote that the angle β is too small. In either event, the evaluating circuit 55 transmits appropriate signals to reduce or enlarge the angle.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making smokers' products and, therefore, such adaptations should and are intended to be comprehended within the meaning and range of equivalence of the appended claims.

What is claimed is:

1. A method of optimizing patterns which are applied to a running web of wrapping material for smokers' products by a cyclically operated paster, comprising the steps of:

making discrete images of successive patterns on the running web;

forming a composite image of the images of at least some of the patterns applied during a cycle of the paster;

comparing the composite image with a reference image; and initiating changes of the discrete patterns when the comparing step indicates a departure of composite image from the reference image.

2. The method of claim 1, wherein said pattern applying step includes advancing the web from the paster at a variable angle and said initiating step includes changing said angle when the composite image departs from the reference image.

3. The method of claim 2, further comprising the steps of comparing the composite image with at least one additional reference image which is indicative of a departure of said angle from an optimal angle in a first direction, and changing said angle in a second direction counter to said first direction when the composite image departs from the at least one additional reference image in said first direction.

4. The method of claim 2, further comprising the steps of comparing the composite image with a first additional reference image which is indicative of a departure of said angle from an optimal angle in a first direction, comparing the composite image with a second additional reference image which is indicative of a departure of said angle from said optimal angle in a second direction counter to said first direction, increasing said angle when the composite image departs from said reference image in a direction toward said first additional reference image, and reducing said angle when the composite image departs from the reference image in a direction toward said second additional reference image.

5. The method of claim 4, wherein the departure in said first direction is indicative of an angle smaller than the angle when the composite image matches said reference image and the departure in said second direction is indicative of an angle greater than the angle when the composite image matches said reference image.

6. Apparatus for monitoring patterns which are applied to a running web of wrapping material for smokers' products, comprising:

an associated paster arranged to cyclically apply adhesive patterns to successive sections of the running web;

a camera arranged to make pictures of successive groups of patterns;

means for evaluating said pictures, including means for making composite images of patterns applied to the running web during a portion at least of each cycle of said paster;

means for displaying said images;

first signal generating means arranged to furnish to said camera a series of first signals at a first frequency, said first signals denoting the rate of application of patterns by said paster; and second signal generating means arranged to transmit to said camera a series of second signals at a second frequency higher than said first frequency, said evaluating means being operatively connected with said camera and said camera being arranged to make a picture substantially in response to each second signal and to transmit the picture to said evaluating means, said evaluating means being arranged to make an image from at least some of the pictures transmitted thereto between successive first signals.

7. The apparatus of claim 6, wherein said paster comprises a paste applicator including one of a rotary valve and a rotary roller, said first signal generating means being operatively connected with said paste applicator in such a way that the latter generates a first signal at the start of each full revolution of said paste applicator.

8. The apparatus of claim 6, wherein said camera is a linear scanning camera arranged to make linear pictures of the patterns on the web.

9. The apparatus of claim 6, further comprising a source of linear radiation arranged to direct radiation upon those successive patterns of the web which are imaged by said camera, said camera having an objective oriented substantially at a glancing angle to the plane of the pattern being imaged by the camera.

10. The apparatus of claim 6, further comprising means for advancing the web in a predetermined direction along a predetermined path, means for severing the web downstream of said paster—as seen in said direction—at a variable frequency to subdivide the web into a series of uniting bands, means for generating signals at a frequency corresponding to the frequency at which the web is severed by said severing means, and means for generating and integrating into the composite images information derived from the frequency of said signals, said information including control markers denoting the cuts made in the web by said severing means.

11. The apparatus of claim 6, further comprising first signal generating means arranged to furnish to said camera a series of first signals at a first frequency, said first signals denoting the rate of application of patterns by said paster, second signal generating means arranged to transmit to said camera a series of second signals at a second frequency higher than said first frequency, said evaluating means being operatively connected with said camera and said camera being arranged to make a picture substantially in response to each second signal and to transmit the picture to said evaluating means, said evaluating means being arranged to make an image from at least some of the pictures transmitted thereto between successive; first signals and further comprising means for advancing the web in a predetermined direction along a predetermined path, means for severing the web downstream of said paster—as seen in said direction—at a variable frequency to subdivide the web into a series of uniting; bands, means for generating third signals at a frequency corresponding to the frequency at which the web is severed by said severing means, and means for generating and integrating into the composite images information derived from the frequency of said third signals, said information including control markers denoting the cuts made in the web by said severing means.

12. Apparatus for optimizing adhesive patterns which are applied seriatim to a running web of wrapping material for smokers' products by a cyclically operated paster, comprising:

a camera arranged to make pictures of successive series of patterns, each of said series including at least some patterns applied during a cycle of the paster;

means for evaluating said pictures and for producing images of pictures of said successive series of patterns; and means for storing a reference image, said evaluating means including means for comparing said images of patterns with said reference image and means for altering the patterns being applied to the web by said paster when the images of said patterns depart from said reference image.

13. The apparatus of claim 12, further comprising means for advancing the web in a predetermined direction and along a predetermined path extending past said paster and thereupon past said camera, said altering means comprising an adjustable deflecting roller engaging the web downstream of said paster and upstream of said camera, as seen in said direction.

14. The apparatus of claim 13, wherein said paster includes a portion which cooperates with said roller to change the orientation of successive increments of the web in response to adjustments of said roller and to thus change the patterns being applied to the web by said paster.

15. The apparatus of claim 12, wherein said storing means is arranged to further store at least one additional reference image indicative of a departure of the images of said patterns from said first mentioned reference image in at least one of two directions, said evaluating means further comprising means for comparing said images of patterns with said at least one additional reference image and said altering means being further arranged to alter said patterns when the images of said patterns depart from said additional reference image.

16. The apparatus of claim 15, wherein said altering means is arranged to change the orientation of the web upstream of said camera in one direction when the images of said patterns depart from said additional reference image in another direction counter to said one direction.

17. The apparatus of claim 12, wherein said storing means is arranged to further store first and second additional reference images respectively indicating departures of the images of said patterns from said first mentioned reference image in a first direction and a second direction counter to said first direction, said evaluating means further including means for comparing said images of said patterns with said additional reference images and said altering means being arranged to alter the patterns being applied to the web when the images of said patterns depart from said additional reference images.

18. The apparatus of claim 17, wherein said altering means includes means for changing the orientation of the web between said paster and said camera in one direction when the images of patterns being applied to the web depart from one of said additional reference images and for changing the orientation of the web between said paster and said camera in another direction counter to said one direction when the images of patterns being applied to the web depart from the other of said additional reference images.

* * * * *